US005995060A

United States Patent [19]

Podger

[11] Patent Number: 5,995,060

[45] Date of Patent: Nov. 30, 1999

[54] STRENGTHENED DOUBLE-DELTA ANTENNA STRUCTURE

[76] Inventor: James Stanley Podger, 55 Gradwell Drive, Scarborough, Ontario, Canada, M1M 2N1

[21] Appl. No.: 08/806,453

[22] Filed: Feb. 26, 1997

[30] Foreign Application Priority Data

Feb. 17, 1997 [CA] Canada ..... 2197725

[51] Int. Cl.[6] ..... H01Q 9/28

[52] U.S. Cl. ..... 343/807; 343/728; 343/792.5; 343/891

[58] Field of Search ..... 343/807, 792.5, 343/795, 786, 891, 728

[56] References Cited

U.S. PATENT DOCUMENTS

| | | | |
|---|---|---|---|
| 2,210,491 | 8/1940 | Lewis | 343/891 |
| 3,210,767 | 10/1965 | Isbell | 343/792.5 |
| 3,932,874 | 1/1976 | Woodward | 343/795 |
| 4,093,952 | 6/1978 | Taylor | 343/728 |
| 4,593,289 | 6/1986 | Newcomb | 343/795 |
| 4,996,535 | 2/1991 | Profera, Jr. | 343/786 |
| 5,790,082 | 8/1998 | Podger | 343/792.5 |

FOREIGN PATENT DOCUMENTS

| | | | |
|---|---|---|---|
| 2170918 | 3/1996 | Canada | H01Q 1/36 |
| 2172742 | 3/1996 | Canada | H01Q 21/22 |

OTHER PUBLICATIONS

Hawker, J. Patrick, "Technical Topics, Double–Delta Aerials for VHF and UHF," *Radio Communications,* Jun. 1969, p. 396.

Tsukiji, Takehiko and Shigefumi Tou, "High–Gain and Broad–Band Yagi–Uda Array Composed of Twin–Delta Loops, " *Antennas and Propagation, Part I: Antennas,* I.E.E.E. Conference Publication No. 195, 1981, pp. 438–441.

Tsukiju, Takehiko et al, "Twin Delta Loop Antenna and Its Application to Antenna with Plane Reflector," *Electronics and Communications in Japan,* part 1, vol. 68, No. 11, 1985, pp. 96–104.

Tsukiju, Takehiko and Yasunori Kumon, "The Crossed Twin–Delta–Loop–Antennas with Different Peripheral Lengths," *Proceedings of The 1985 International Symposium on Antennas and Propagation,* Japan, pp. 481–484.

Kraus, John D., "A Small But Effective 'Flat Top' Beam," *Radio,* Mar. 1937, pp. 56–58.

Podger, J. S., Analysis Results, Regular Double Delta.

Podger, J. S., Analysis Results, Strenghthened Double Delta.

*Primary Examiner*—Don Wong
*Assistant Examiner*—Hoang Nguyen

[57] ABSTRACT

An improvement is disclosed to an antenna structure that is a pair of coplanar triangular loops with a corner of each triangle at the center and the triangle sides opposite those corners placed parallel to each other to form the outer sides of the structure. The improvement is extra conductors placed between the central point and the center of the outer parallel sides. This improvement not only strengthens the structure, which may be important in the high-frequency spectrum, but it also is convenient for turnstile and log-periodic arrays of such structures.

44 Claims, 6 Drawing Sheets

STRENGTHENED DOUBLE-DELTA ANTENNA STRUCTURE

FIELD OF THE INVENTION

This invention relates to antenna structures, specifically to antenna structures that are pairs of triangles called double-delta antenna structures. This application is the U.S. version of Canadian patent application 2,197,725. The invention is an addition to the structure that improves its strength. Hereinafter, the improved structure will be called a strengthened double-delta antenna structure. This improvement is particularly convenient for turnstile arrays of such structures. The improvement also makes convenient the construction of log-periodic arrays of such structures.

LIST OF DRAWINGS

The background of this invention as well as the objects and advantages of the invention will be apparent from the following description and appended drawings, wherein.

PRIOR ART

Figure 1A:
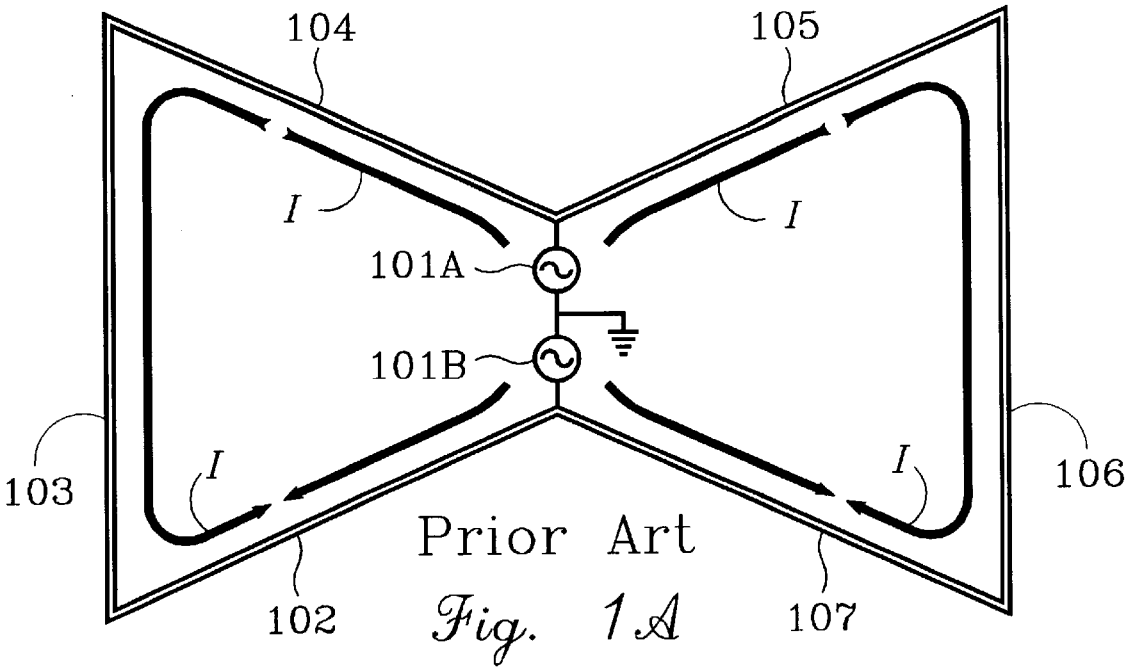
Prior Art Fig. 1A
FIG. 1A illustrates a double-delta antenna structure.

In June, 1969, Patrick Hawker disclosed in *Radio Communications* that John Pegler had been using pairs of triangles, one wavelength in perimeter, in Yagi-Uda arrays for "some years." As FIG. 1A shows, these were two identical triangles, with a corner of each triangle at the center and the sides opposite those corners positioned parallel to each other to form the outer parts of the structure. Parts 102 to 107 form the double-delta antenna structure. Hereinafter in this description and the attached claims, parts 103 and 106 will be called the parallel conductors. Hereinafter in this description and the attached claims, parts 102, 104, 105 and 107 will be called the diagonal conductors.

The two generator symbols, 101A and 101B, represent the connection to the associated electronic equipment. Hereinafter in this description and the attached claims, the associated electronic equipment will be the equipment usually attached to antennas. That equipment would include not only transmitters and receivers for communications, but also such devices as radar equipment and equipment for security purposes. Two generators are illustrated in order to imply that the connection should be balanced around the center point, which is represented by the ground symbol. Of course, the real connection probably would be made through a double T match as in FIG. 3 or 4, or by a direct balanced connection as in FIG. 5.

Pegler's structure should not be confused with structures that have the associated electronic equipment connected between the two loops. Such structures are essentially dipoles that have more than one current path between the center and the outer ends of the structure. The structures discussed in this patent are connected between one side of both loops and the other side of both loops. This produces a considerably different current pattern and, therefore, a considerably different kind of antenna.

Figure 1B:
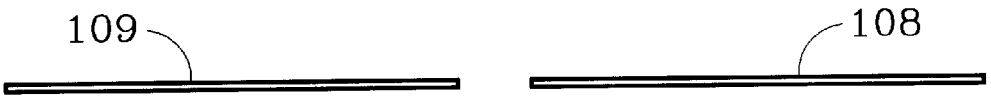
FIG. 1B illustrates the added parts.
Figure 1C:
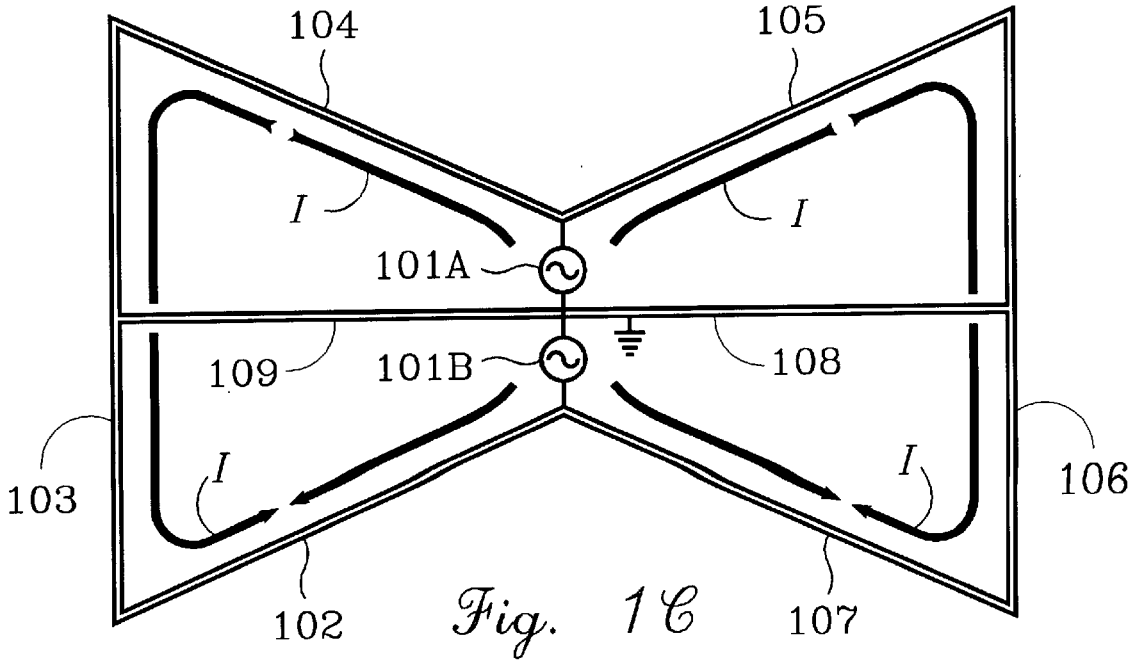
FIG. 1C illustrates the basic strengthened double-delta antenna structure, which is the subject of this patent.

In addition to the lines representing conductors in FIGS. 1A and 1C, there also are relatively wide arrows representing some aspects of the currents. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls and the currents immediately on either side of these points would be flowing in opposite directions. However, beside these notations of where the current maxima and minima would be located, not much else is denoted by these arrows. Particularly, one should not assume that the currents at the centers of all the current paths have equal magnitudes and phases even though all of these currents are denoted as I. In general, the interaction of the currents will produce a complicated amplitude and phase relationship between these currents. Nevertheless, it would be unusual if the phase of these currents were more than 90 degrees away from the phase implied by the direction of the arrows. That is, the phase would not be so different from an implied zero degrees that the arrows should be pointed in the opposite direction because the phase is closer to 180 degrees than to zero degrees.

Of course, these current directions are just the directions of particular currents relative to the directions of other currents. They are obviously all alternating currents, which change directions according to the frequency of operation.

Because of the symmetry, it is apparent that the parallel conductors carry large, approximately equal currents and those currents would aid each other in producing radiation perpendicular to the plane of the structure. The currents near the center of the structure are also large, but because they are flowing in almost opposite directions into and out of the center, their effect on the total radiation tends to cancel. Indeed, this cancellation of radiation helps to reduce the radiation in undesired directions. The net effect is a maximum of performance perpendicular to the plane of the structure, and less performance in other directions. If the parallel conductors were approximately 0.33 free-space wavelengths long and there were approximately 0.68 free-space wavelengths between the parallel conductors, the radiation would be greatly reduced in the two directions in the plane of the structure that are perpendicular to the parallel conductors. This reduction in the radiation in undesired directions gives the structure directivity in the plane that is perpendicular to the parallel conductors. Hereinafter in this description and the attached claims, this plane will be called the principal H (magnetic field) plane, as is conventional. The plane that is perpendicular to both the principal H plane and the plane of the antenna structure will hereinafter in this description and the attached claims be called the principal E (electric field) plane, which also is conventional.

Most important, the structure produces more gain at elevation angles near the horizon for horizontally polarized antennas. This ability to produce stronger signals near the horizon is important in and above the very-high frequencies because signals generally arrive at low vertical angles. Fortunately, it is not difficult to put signals near the horizon at such frequencies because it is the height in terms of wavelengths that matters and, with such short wavelengths, antennas easily can be positioned several wavelengths above the ground. It also is important to put signals near the horizon at high frequencies because long-distance signals arrive at angles near the horizon and they usually are the weaker signals. This is more difficult to achieve, because the longer wavelengths determine that antennas usually are close to the ground in terms of wavelengths.

THE INVENTION

This structure works well and is not particularly weak, but its strength can be improved. When the structure is large, as it would be in the high-frequency spectrum, some extra strength is useful at least to reduce the movement in the wind. Since metals usually are stronger than insulators, one would want to use a metal for any strengthening part. Unfortunately, metals added to an antenna usually will modify the performance of the antenna. Therefore, if the strengthening part were metal, it would be desirable to place it in a position such that the additional part would not have any net effect on the antenna performance.

If the associated electronic equipment were attached to the antenna structure in a balanced manner, as it should be to reduce the radiation in undesired directions, the voltage at the center would be at ground potential. Away from that junction on one particular loop, there would be instantaneous voltages of equal magnitude but opposite polarities at places that are equidistant from the center. The voltages would be of equal magnitude, because they are equidistant from the ground and because the structure is symmetrical. The voltages would be of opposite polarities, because no net current would flow between these points if they had voltages of the same polarity.

The center of the parallel conductor of either loop is equidistant from the center point by the two paths around the loop. Therefore, the voltage at that point must be equal in magnitude and of opposite polarity to itself. Obviously, the only voltage that satisfies those conditions is zero volts. That is, whatever the voltages may be at other parts of the loop, they must reach zero volts at the center of the parallel conductor. In other words, that point is at ground potential.

If the center point of the whole structure and the center of the parallel conductors were both at ground potential, it is apparent that if conductors 108 and 109 of FIG. 1B were connected between those points, as shown in FIG. 1C, no currents would flow in them because of that connection. Hereinafter in this description and the attached claims, these added conductors will be called the perpendicular conductors. In addition, an examination of the current patterns around those perpendicular conductors shows that those conductors are equidistant from currents flowing in opposite directions in the other conductors. That is, there would be no net fields inducing currents into those perpendicular conductors. They would be conductors that did not conduct because no net voltages were applied to them by conduction or induction. As far as the electrical performance of the strengthened double-delta structure is concerned, the perpendicular conductors might as well not be there.

Of course, for the above situation to be absolutely true, the structure must be perfectly balanced. However, if the balance were good enough, the currents in the perpendicular conductors would be small enough to be insignificant.

Turning to construction matters, the desirable cross-sectional size of antenna conductors depends, of course, upon mechanical as well as electrical considerations. For example, the large structures needed in the high-frequency spectrum probably would have conductors formed by several sizes of tubing. This is because the parts at the ends of the structure support only themselves while the parts near the center must support themselves and the parts further out in the structure. This variety of mechanical strengths required would make convenient a variety of conductors.

At ultra-high frequencies, on the other hand, it may be convenient to construct these antennas using single pieces of tubing for several parts, because only a small cross-sectional area may be needed anywhere in such small structures.

There are many conventional and acceptable means of connecting the various parts of strengthened double-delta antenna structures. For example, they could be bolted, held by various kinds of clamps, or soldered, brazed or welded with or without pipe fittings at the joints. As long as the effect of the means of connection upon the effective length of the parts is taken into account, there seems to be no conventional means of connecting antenna parts that would not be acceptable for strengthened double-delta antenna structures. However, before the final dimensions have been obtained, it is convenient to use clamps that allow adjustments to the length of the parallel conductors. Often a computer-aided design will produce reasonably correct distances between the parallel conductors and between the various strengthened double-delta antenna structures in the array. Therefore, adjusting only the lengths of the parallel conductors on the antenna range will be an acceptable tactic to produce a final design.

APPLICATION—TURNSTILE ARRAYS

Figure 2:
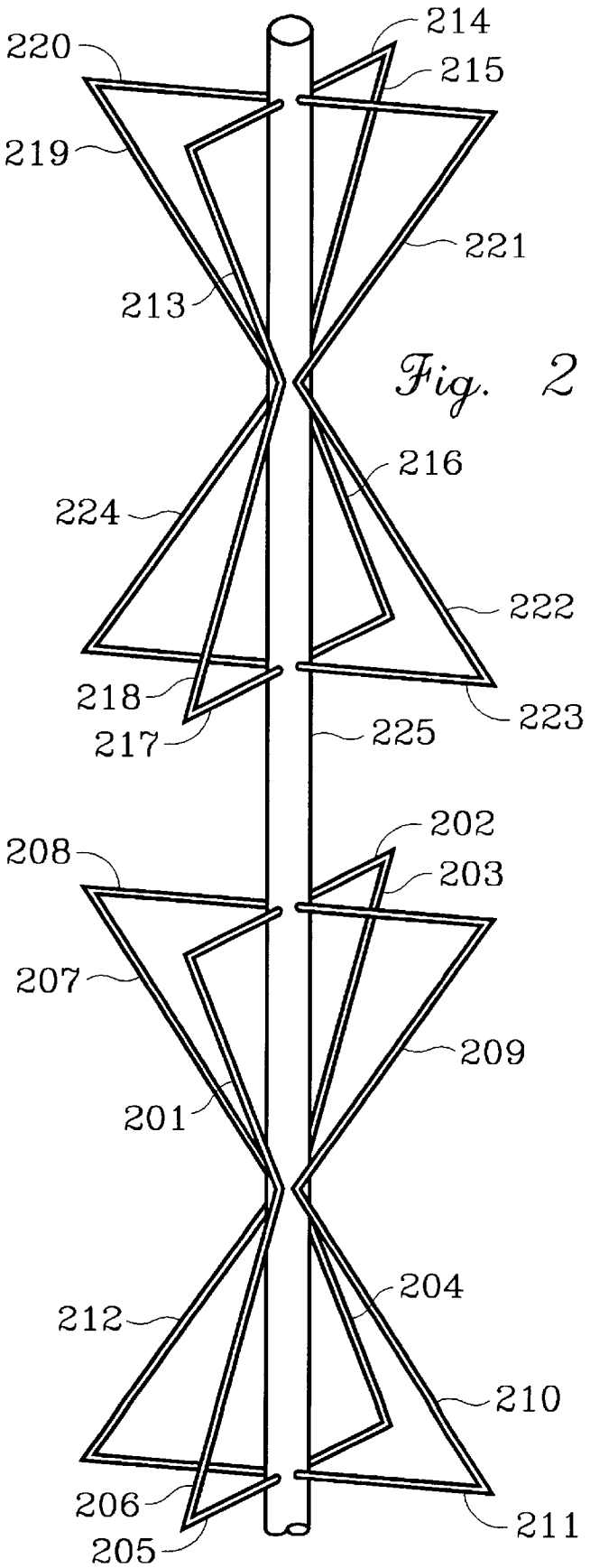
FIG. 2 illustrates two turnstile arrays of the improved structure.

These structures usually can be used in the ways that regular double-delta antenna structures are used. That is, several of them can been combined to produce better antennas. Within many articles, Professor Takehiko Tsukiji and his colleagues at Fukuoka University have analyzed Pegler's antenna in, for example, Yagi-Uda arrays in I.E.E.E. Conference Publication 195 in 1981; in front of a reflecting screen in *Electronics and Communications in Japan,* Vol. 68, No. 11, in 1985; and as parts of elliptically polarized arrays in the *Proceedings of The* 1985 *International Symposium on Antennas and Propagation,* in Japan. This writer has disclosed their use in turnstile arrays in Canadian patent application 2,170,918 and in log-periodic arrays in Canadian patent application 2,172,472. One such array of strengthened double-delta antenna structures is illustrated by FIG. 2. It illustrates the use of these structures in two turnstile arrays to obtain a horizontally-polarized radiation pattern that is omnidirectional in the horizontal plane. Such arrays might be needed by a broadcast station or by networks of stations. As with the classical turnstile array of dipoles, this array has two structures positioned at right angles and energized with signals that are equal in amplitude and unequal in phase by 90 degrees. The lower array has the structure having parts 201 to 206 and the structure having parts 207 to 212. The upper array has the structure having parts 213 to 218 and the structure having parts 219 to 224. Because the feeding system would be conventional for turnstile arrays and would unnecessarily complicate the diagram if it were shown, the feeding system was omitted from this diagram.

The use of strengthened double-delta antenna structures is convenient because their perpendicular conductors are grounded. Therefore, those conductors can be used as the grounded mast (225) that is supporting the whole array. Since some kind of mast would be needed anyway, the perpendicular conductors are not really added parts in this case. When more than one turnstile array is used, as in FIG. 2, this central metal support is particularly convenient for producing a strong antenna by allowing several metallic connections to the mast. It also would be convenient to choose dimensions that would reduce the radiation in the direction parallel to the central support (up and down) so that there would less interaction between the turnstile arrays and the impedances would be substantially equal.

Of course, turnstile arrays could be made with three or more strengthened double-delta antennas structures, spaced physically and electrically by less than 90 degrees. For example, three structures could be spaced by 60 degrees. Such structures may produce a radiation pattern that is closer to being perfectly omnidirectional, but such an attempt at perfection would seldom be necessary. More useful might be two structures spaced physically and electrically by angles that may or may not be 90 degrees, with equal or unequal energy applied. Such an array could produce a somewhat directive pattern, which might be useful if coverage were needed more in some directions than in other directions.

APPLICATION—COLLINEAR AND BROADSIDE ARRAYS

Another application of strengthened double-delta antenna structures arises from observing that half-wave dipoles traditionally have been positioned in the same plane either end-to-end (collinear array), side-by-side (broadside array), or in a combination of those two arrangements. Often, a second set of such dipoles, called reflectors or directors, is put into a plane parallel to the first one, with the dimensions chosen to produce a somewhat unidirectional pattern of radiation. Sometimes an antenna structure is placed in front of a reflecting screen (317), as in FIG. 3. Hereinafter in this description and the attached claims, the front end of an antenna will be the end pointing in the direction of the desired radiation. The rear end of an antenna will be the opposite end from the front end. Such arrays have been used on the high-frequency bands by short-wave broadcast stations, on very-high-frequency bands for television broadcast reception, and by radio amateurs.

Figure 3:
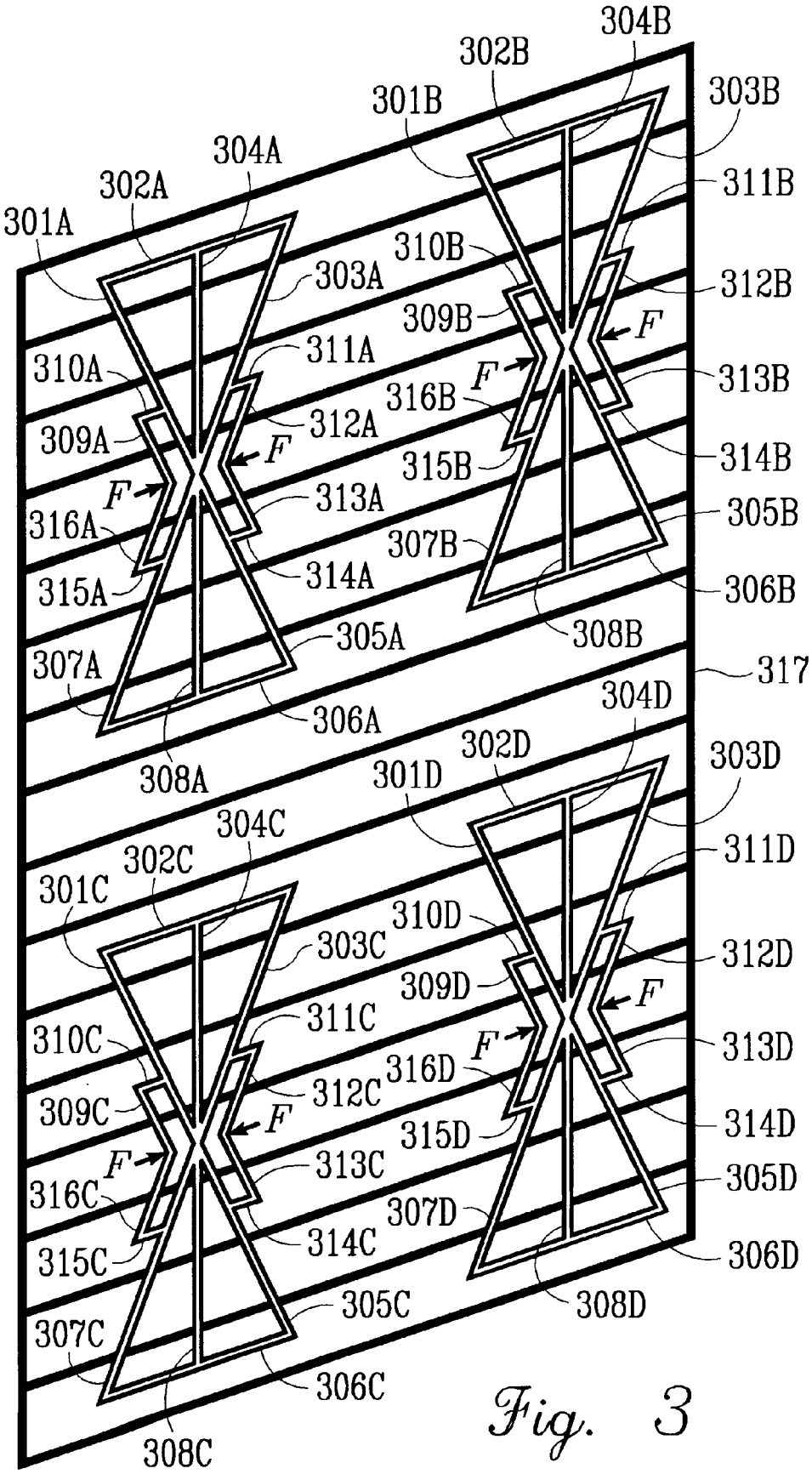
FIG. 3 illustrates an array of the improved structures in front of a reflective screen.

The same tactics can be used with strengthened double-delta antenna structures, as FIG. 3 shows. The array having parts 301A to 316A is in a collinear arrangement with the array having parts 301B to 316B, because their corresponding parallel conductors are aligned in the direction parallel to the parallel conductors. That is, their parallel conductors are positioned end-to-end. The array having parts 301C to 316C and the array having parts 301D to 316D are similarly positioned. The A array is in a broadside arrangement with the C array, because their corresponding parallel conductors are aligned in the direction perpendicular to the parallel conductors. The B array and the D array are similarly positioned.

Perhaps the main advantage of using strengthened double-delta antenna structures rather than dipoles in such arrays is the less complicated system of feeding the array for a particular overall array size. That is, each strengthened double-delta antenna structure would perform in such an array as well as two or more half-wave dipoles.

Sometimes collinear or broadside arrays of dipoles have used unequal distributions of energy between the dipoles to reduce the radiation in undesired directions. The same tactics also could be used with the turnstile arrays of FIG. 2, if there were more than two such arrays in the antenna. However, since strengthened double-delta antenna structures reduce such undesired radiation anyway, there would be less need to use unequal energy distributions in equivalent arrays to achieve the same kind of result. Nevertheless, if such an unequal energy distribution were used, it should be less complicated to implement because of the less complicated feeding system.

Since the impedance of a strengthened double-delta antenna structure probably will not equal the characteristic impedance of the transmission line leading to the associated electronic equipment, some kind of matching system will be desirable in most cases. For matching a half-wave dipole, a T match tuned with capacitors in series with the T conductors is a conventional choice. FIG. 3 somewhat illustrates that matching system with the T parts, 309, 312, 313 and 316, in all four structures, and the short circuits to the diagonal parts, 310, 311, 314 and 315. The capacitors and balanced-to-unbalanced transformers, if the transmission line were unbalanced, would be connected to the feeding points, F. This is all conventional practice for connecting to a balanced antenna.

APPLICATION—YAGI-UDA ARRAYS

Figure 4:
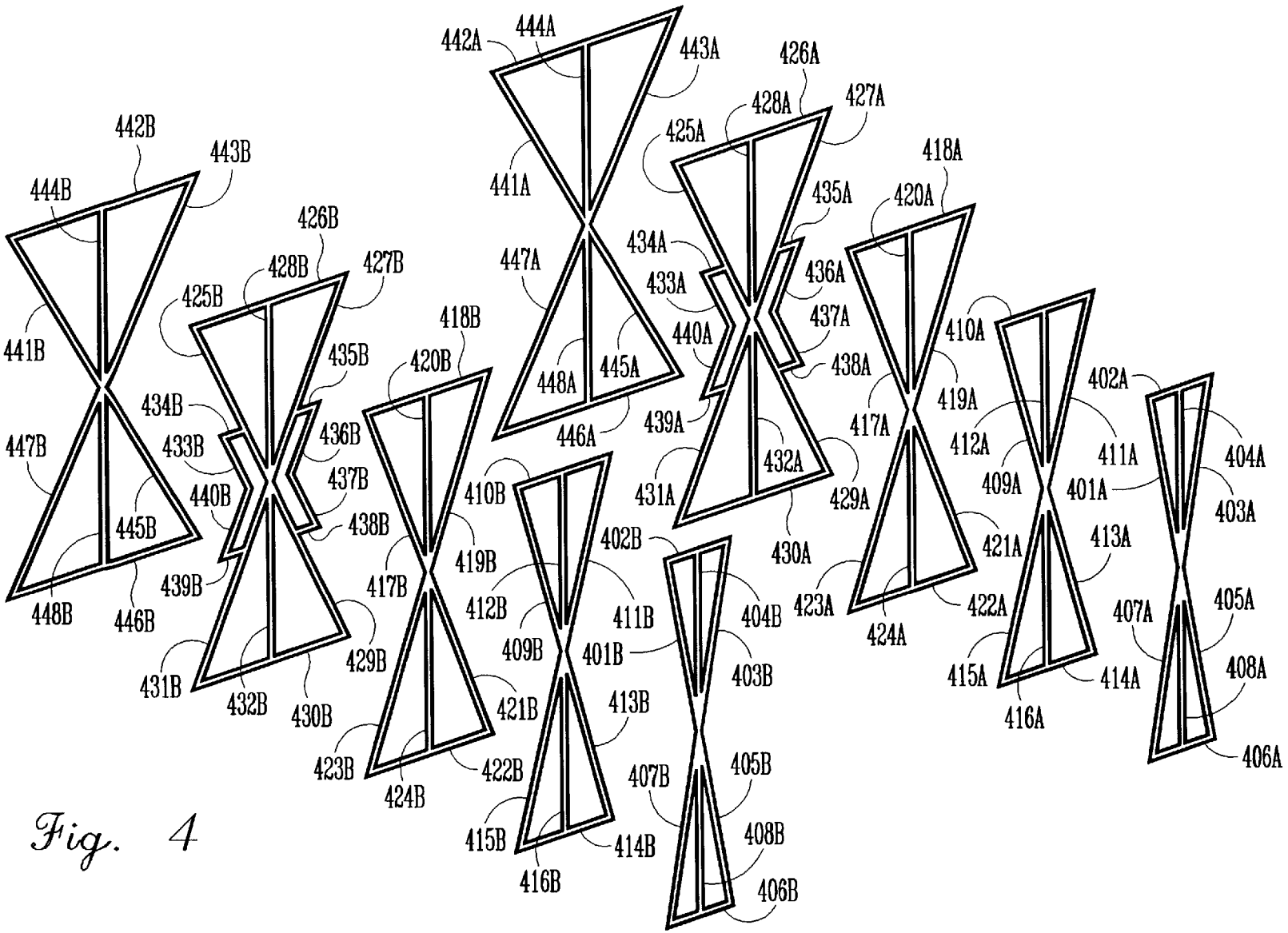
FIG. 4 illustrates two Yagi-Uda arrays of the improved structures.

Yet another application, commonly called an end-fire array, has several strengthened double-delta antenna structures positioned so that they are in parallel planes and the parallel conductors in each structure are parallel to the parallel conductors in the other structures. One strengthened double-delta antenna structure, some of them, or all of them could be connected to the associated electronic equipment. If the second strengthened double-delta antenna structure from the rear were so connected, as in FIG. 4, and the dimensions produced the best performance toward the front, the array could logically be called a Yagi-Uda array of strengthened double-delta antenna structures. Hereinafter, that name will be used for such structures. FIG. 4 illustrates two such Yagi-Uda arrays in a collinear arrangement: parts 401A to 448A forming one of them and parts 401B to 448B forming the other one. Hereinafter the strengthened double-delta antenna structures having the T-match parts, 433A to 440A and 433B to 440B, will be called the driven structures. The structures to the rear with parts 441A to 448A and parts 441B to 448B will be called the reflector structures. The remaining structures will be called the director structures. This terminology is conventional with the traditional names for dipoles in Yagi-Uda arrays. Another less popular possible array would be to have just two such structures with the rear one connected, called the driven structure, and the front one not connected, called the director structure.

The tactic traditionally used for designing a Yagi-Uda array is to employ empirical methods rather than equations. This is partly because there are many combinations of dimensions that would be satisfactory for a particular application. Fortunately, there are computer programs available that can refine designs if reasonable trial designs are presented to the programs. That is as true of strengthened double-delta arrays as it is for dipole arrays. To provide a trial design, it is common to make the driven structure resonant near the operating frequency, the reflector structure resonant at a lower frequency, and the director structures resonant at progressively higher frequencies from the rear to the front. Then the computer program can find the best dimensions near to the trial dimensions.

The use of strengthened double-delta antenna structures in such an array is similar to the use of regular double-delta antenna structures, but one point deserves emphasis. In arrays that have strengthened double-delta antenna structures aligned from the front to the rear, one should remember that the principal radiating parts, the parallel conductors, should preferably be aligned to point in the direction of the desired radiation, perpendicular to the planes of the individual structures. That is somewhat important in order to achieve the maximum gain, but it is more important in order to suppress the radiation in undesired directions. Therefore, when the resonant frequencies of the structures must be unequal, the lengths of the parallel conductors should be chosen so that the distances between the parallel conductors are equal. That is, the distances between the parallel conductors should preferably be chosen to get the desired pattern in the principal H plane, and the lengths of the parallel conductors should be changed to achieve the other goals, such as the desired gain.

APPLICATION—ALL-DRIVEN ARRAYS

Figure 5:
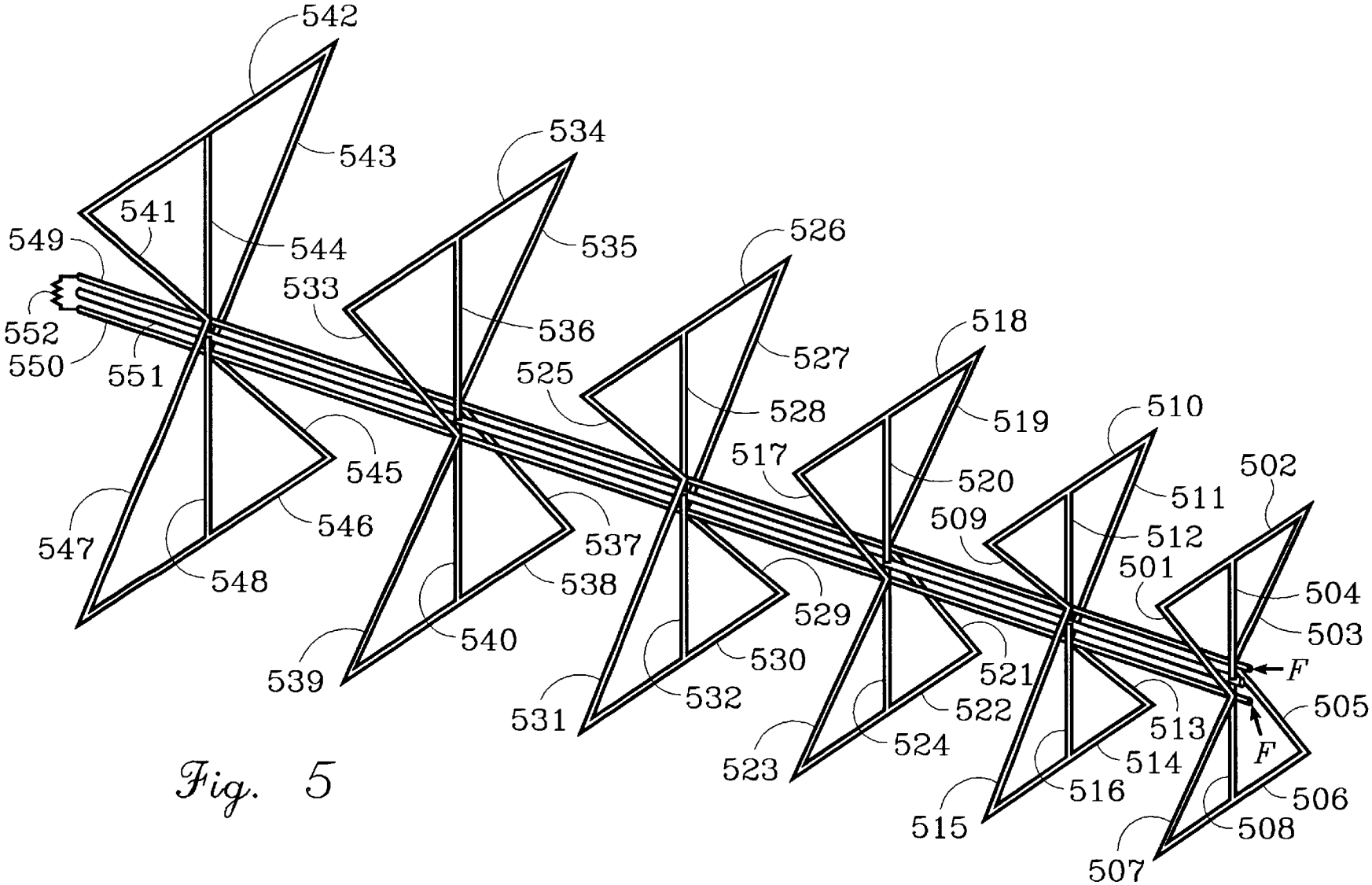
FIG. 5 illustrates a log-periodic array of the improved structures.

There are several possibilities for all-driven end-fire arrays but, in general, the mutual impedances make such designs rather challenging and the bandwidths can be very small. The log-periodic array, as illustrated by FIG. 5, is a notable exception. A smaller, feasible all-driven array would be just two identical strengthened double-delta antenna structures that are fed 180 degrees out of phase with each other. The space between the structures would not be critical, but one-eighth of a wavelength would be a reasonable value. This would be similar to the dipole array disclosed by John D. Kraus in *Radio* of March 1937, which is commonly called a W8JK array, after his amateur-radio call letters. Since the impedances of the two structures are equal when the phase difference is 180 degrees, it is relatively easy to achieve an acceptable bidirectional antenna by applying such tactics. If a balanced transmission line were used, the conductors going to one structure would be simply transposed. For coaxial cable, an extra electrical half wavelength of cable going to one structure might be a better device to provide the desired phase reversal. If the space were available, such a bidirectional array of strengthened double-delta antenna structures could be very desirable in the lower part of the high-frequency spectrum where rotating antennas may not be practicable because they are very large.

Another possibility is two structures spaced and connected so that the radiation in one direction is almost canceled. An apparent possibility is a space between the structures of a quarter wavelength and a 90-degree phase difference in the connections. Other space differences and phase differences to achieve unidirectional radiation will produce more or less gain, as they will with half-wave dipoles.

The log-periodic array of strengthened double-delta antenna structures is similar in principle to the log-periodic dipole antenna disclosed by Isbell in his U.S. Pat. No. 3,210,767. Hereinafter, that combination will be called a strengthened double-delta log-periodic array. Log-periodic arrays of half-wave dipoles are used in wide-band applications for military and amateur radio purposes and for the reception of television broadcasting. The merit of such arrays is a relatively constant impedance at the terminals and a reasonable radiation pattern across the design frequency range. However, this is obtained at the expense of gain. That is, their gain is poor compared to narrow band arrays of similar lengths. Although one would expect that gain must be traded for bandwidth in any antenna, it is nevertheless disappointing to learn of the low gain of such relatively large arrays.

If one observes the E-plane radiation pattern of a typical log-periodic dipole array, it appears to be a reasonable pattern of an antenna of reasonable gain because the major lobe of radiation is reasonably narrow. However, the principal H plane shows a considerably wide major lobe that indicates poor gain. This poor performance in the principal H plane is, of course, caused by the use of half-wave dipoles. Because half-wave dipoles have circular radiation patterns in the principal H plane, they do not help the array to produce a narrow major lobe of radiation in that plane.

Strengthened double-delta antenna structures are well suited to improve the log-periodic array because they can be designed to suppress the radiation 90 degrees away from the center of the major lobe. That is, for a horizontally polarized log-periodic array, as in FIG. 5, the radiation upward and downward is suppressed. However, since the overall array of parts 501 to 552 produces strengthened double-delta antenna structures of various sizes, several of which are used at any particular frequency, it is overly optimistic to expect that the radiation from the array in those directions will be suppressed as well as it can be from a single strengthened double-delta antenna structure operating at one particular frequency. Nevertheless, the reduction of radiation in those directions and, consequently, the improvement in the gain can be very significant.

A difficulty with log-periodic arrays is that the conductors that are feeding the various antenna structures in the array also are supporting those structures physically. In FIG. 5, they are parts 549 and 550. Hereinafter in this description and the attached claims, those conductors will be called the feeder conductors. That situation requires, first of all, that the feeder conductors must not be grounded. Therefore, these feeder conductors must be connected to the supporting mast by insulators. Not only is this undesirable, because insulators usually are weaker than metals, but it is undesirable because it would be preferable to have a grounded antenna for lightning protection. Another difficulty is that because the characteristic impedance between the feeder conductors should be rather high, the large size of the feeder conductors needed for mechanical considerations requires a wide spacing between these conductors to obtain the desired impedance. That also requires supporting insulators that are longer than would be desired.

The common method of constructing log-periodic arrays is to support the antenna structures by insulators connected to the grounded boom instead of using strong feeder conductors. Then the connections between the structures are made with a pair of wires that cross between adjacent structures. Not only is such a system undesirable because the structures are supported by insulators, but also it is undesirable because the feeder conductors do not have a constant characteristic impedance. Nevertheless, many people seem to be satisfied with this compromise.

Because the strengthened double-delta antenna structures can be supported by the perpendicular conductors, which can be attached with metal clamps to the grounded boom, 551, they offer particular benefits in log-periodic arrays. Since the diagonal conductors need not support very much, they can be small in cross-sectional area. Likewise, since the feeder conductors are merely attached to the diagonal conductors, rather than supporting them, the feeder conductors also can be small in cross-sectional area. Therefore, there is less need for wide spaces between the boom and the feeder conductors to achieve the required characteristic impedance. This reduces the length of the insulators holding the feeder conductors and reduces the strength required in those insulators. In addition, the whole antenna can be grounded through the boom and mast. Therefore, much of the mechanical problems of log-periodic arrays are solved by the use of the perpendicular conductors.

As stated above in the discussion of Yagi-Uda arrays, arrays that have strengthened double-delta antenna structures aligned from the front to the rear should preferably have their parallel conductors aligned to point in the direction of the desired radiation, perpendicular to the planes of the individual structures. That is, the distances between the parallel conductors should be equal. Hereinafter, thinking of a horizontally polarized array as in FIG. 5, the distance between the outer parallel conductors will be called the height. The length of the parallel conductors will be called the width. That equal-height alignment usually is not a problem with Yagi-Uda arrays. This is partly because only one strengthened double-delta antenna structure in the array is connected to the associated electronic equipment, and partly because the range of frequencies to be covered usually is small enough that there is not a great difference in the sizes of the various strengthened double-delta antenna structures in the array. Therefore, it is preferable and convenient to align the parallel conductors.

A strengthened double-delta log-periodic array presents a problem in this respect partly because the purpose of log-periodic arrays is to cover a relatively large range of frequencies. Therefore, the range of dimensions is relatively large. It is not unusual for the resonant frequency of the largest structure in a log-periodic array to be one-half of the resonant frequency of the smallest structure. One result of this is that if one tried to achieve that range of resonant frequencies with a constant height, it is common that the appropriate height of the largest strengthened double-delta antenna structure in the array for a desirable radiation pattern at the lower frequencies would be larger than the perimeter of the loops of the smallest structure. Hence, such an equal-height array would be practicable only if the range of frequencies covered were not very large.

Another reason for the problem is that all of the individual strengthened double-delta antenna structures are connected in a log-periodic array. Therefore, the relationship between the impedances of the structures is important. The problem of equal-height log-periodic designs is that the impedances of high and narrow strengthened double-delta antenna structures are quite different from the impedances of short and wide versions. The design of the connecting system, which depends on those impedances, could be unduly complicated if these unequal impedances were taken into account. In addition, the design could be complicated by the fact that the radiation pattern would change if the ratio of the height to width were changed. Therefore, instead of using equal heights, it may be preferable to accept the poorer gain and poorer suppression of radiation to the rear resulting from the nonaligned parallel conductors, in order to use strengthened double-delta antenna structures that are proportional to each other in height and width.

Sometimes, a compromise between the extremes of equal height and proportional dimensions is useful. For example, the resonant frequencies of adjacent strengthened double-delta antenna structures may conform to a constant ratio, the conventional scale factor, but the heights may conform to some other ratio, such as the square root of the scale factor.

APPLICATION—LOG-PERIODIC DESIGN TACTICS

Whether equal-height strengthened double-delta antenna structures or proportional dimensions are used, the design principles are similar to the traditional principles of log-periodic dipole arrays. However, the details would be different in some ways. The scale factor ($\tau$) and the spacing factor ($\sigma$) usually are defined in terms of the dipole lengths, but there would be no such lengths available if the individual structures were not dipoles. It is better to interpret the scale factor as the ratio of the resonant wavelengths of adjacent strengthened double-delta antenna structures. If the design were proportional, that also would be the ratio of any corresponding dimensions in the adjacent structures. For example, for the proportional array of FIG. 5, the scale factor would be the ratio of any dimension of the second largest structure formed by parts 533 to 540 divided by the corresponding dimension of the largest structure formed by parts 541 to 548. The spacing factor could be interpreted as the ratio of the individual space to the resonant wavelength of the larger of the two strengthened double-delta antenna structures adjacent to that space. For example, the spacing factor would be the ratio of the space between the two largest strengthened double-delta antenna structures to the resonant wavelength of the largest structure.

Some other standard factors may need more than reinterpretation. For example, since the impedances of strengthened double-delta antenna structures are not the same as the impedances of dipoles, the usual impedance calculations for log-periodic dipole antennas are not very useful. Also, since the antenna uses some strengthened double-delta antenna structures that are larger and some that are smaller than resonant structures at any particular operating frequency, the design must be extended to frequencies beyond the operating frequencies. For log-periodic dipole antennas, this is done by calculating a bandwidth of the active region, but there is no such calculation available for the strengthened double-delta log-periodic antenna. Since the criteria used for determining this bandwidth of the active region were quite arbitrary, this bandwidth may not have satisfied all uses of log-periodic dipole antennas anyway.

However, if the array had a constant scale factor and a constant spacing factor, the structures were connected with a transmission line with a velocity of propagation near the speed of light, like open wire, and the connections were reversed between each pair of structures, the result would be some kind of log-periodic array. In FIG. 5, that transmission line is formed by the two feeder conductors 549 and 550 and the boom, 551. The connection reversal is achieved by alternately connecting the left and right sides of the strengthened double-delta antenna structures to the top and bottom feeder conductors. For example, the left side diagonal conductors of the largest structure, 541 and 547, are connected to the top feeder conductor, 549, but the left side diagonal conductors of the second largest structure, 533 and 539, are connected to the bottom feeder conductor, 550. The frequency range, the impedance, and the gain of such an array may not be what the particular application requires, but it will nevertheless be a log-periodic structure. The task is just to start with a reasonable trial design and to make adjustments to achieve an acceptable design.

This design approach is practicable because computer programs allow us to test antennas before they exist. No longer is it necessary to be able to calculate the dimensions with reasonable accuracy before an antenna must be made in the real world. The calculations can now be put into a computer spreadsheet, so the result of changes can be seen almost instantly. If the results of the calculations seem promising, an antenna simulating program can show whether the design is acceptable to a reasonable degree of accuracy.

To get a trial log-periodic design, the procedure could be as follows. What would be known is the band of frequencies to be covered, the desired gain, the desired suppression of radiation to the rear, the desired length of the array, and the number of strengthened double-delta antenna structures that could be tolerated because of the weight and cost. The first factors to be chosen would be the scale factor ($\tau$) and the spacing factor ($\sigma$). The scale factor should be rather high to obtain proper operation, but it is a matter of opinion how high it should be. Perhaps a value of 0.88 would be a reasonable minimum value. A higher value would produce more gain. The spacing factor has an optimum value for good standing wave ratios across the band, good suppression of the radiation to the rear, and a minimum number of strengthened double-delta antenna structures for a particular gain. Perhaps it is a good value to use to start the process.

$$\sigma_{opt}=0.2435\tau-0.052$$

Since the resonant frequencies of the largest and smallest strengthened double-delta antenna structures cannot be calculated yet, it is necessary just to choose a pair of frequencies that are reasonably beyond the actual operating frequencies. These chosen frequencies allow the calculation of the number (N) of strengthened double-delta antenna structures needed for the trial value of scale factor ($\tau$).

$$N=1+\log(f_{min}/f_{max})/\log(\tau)$$

Note that this value of N probably will not be an integer, which it obviously must be. The values chosen above must be changed to avoid fractional numbers of strengthened double-delta antenna structures.

The calculation of the length of the array requires the calculation of the wavelength of the largest strengthened double-delta antenna structure. This can, of course, be done in any units.

$$\lambda_{max}=9.84\times10^8/f_{min}\ \text{ft}$$

$$\lambda_{max}=3\times10^8/f_{min}\ m$$

The length will be in the same units as the maximum wavelength.

$$L=\lambda_{max}\sigma(1-f_{min}/f_{max})/(1-\tau)$$

Therefore, the input to the calculations could be $f_{min}$, $f_{max}$, $\tau$ and $\sigma$, and the desired results could be N and L. Using the optimum value of the spacing factor, the calculation usually would produce a design that was longer than was tolerable. On the other hand, if a longer length could be tolerated, the scale factor could be increased to obtain more gain. To reduce the length, the prudent action usually is to reduce the spacing factor, not the scale factor, because that choice usually will maintain a reasonable frequency-independent performance.

Once a tolerable design is revealed by these calculations, they should be tested by an antenna simulating program. The largest strengthened double-delta antenna structure would be designed using the lowest design frequency ($f_{min}$). The dimensions of the remaining structures would be obtained by successively multiplying the dimensions by the scale factor. The spaces between the structures would be obtained by multiplying the wavelength of the larger adjacent structure by the spacing factor.

An additional factor needed for the program would be the distance between the feeder conductors and the boom. The characteristic impedance of the feeding system would be the sum of the impedances between each feeder conductor and the boom. Since a total impedance of 200 ohms or more is recommended, the spacing between each feeder conductor and the boom would be chosen to produce 100 ohms or more.

The gain, front-to-back ratio, and standing wave ratio of this first trial probably would indicate that the upper and lower frequencies were not acceptable. At least, the spacing between the feeder conductors probably should be modified to produce the best impedance across the band of operating frequencies. Then new values would be entered into the calculations to get a second trial design.

What is an acceptable performance is, of course, a matter of individual requirements and individual standards. For that reason, variations from the original recommended practice are common. First, the optimum value of the spacing factor usually is not used in log-periodic dipole antennas because it would make the antennas too long.

Secondly, although the extension of the feeder conductors behind the largest strengthened double-delta antenna structure was recommended in early literature, it is seldom used. The original recommendation was that it should be about an eighth of a wavelength long at the lowest frequency and terminated in the characteristic impedance of the feeder conductors, which termination is represented by the resistance symbol 552. It was a more common practice to make the termination a short circuit. Note that the boom also extends toward the termination as well in FIG. 5 because it is a part of the characteristic impedance of the feeding system.

If the antenna were designed for proper operation, the current in the termination would be very small anyway, so the termination would do very little and usually could be eliminated. Actually, extending or not extending the feeder conductors may not be the significant choice. There may be a limit to the length of the feeder conductors. In that case, the choice may be whether it is better to raise the spacing factor to use the whole available length to support the strengthened double-delta antenna structures or to spend a part of that available length for an extension.

The log-periodic array of FIG. 5 illustrates the appropriate connecting points, F, to serve a balanced transmission line leading to the associated electronic equipment. Other tactics for feeding unbalanced loads and higher impedance balanced loads also are used with log-periodic dipole antennas. Because these tactics depend only on some kind of log-periodic structure connected to two parallel tubes, these conventional tactics are as valid for such an array of strengthened double-delta antenna structures as they are for such arrays of half-wave dipoles.

APPLICATION —LARGE ARRAYS

Figure 6:
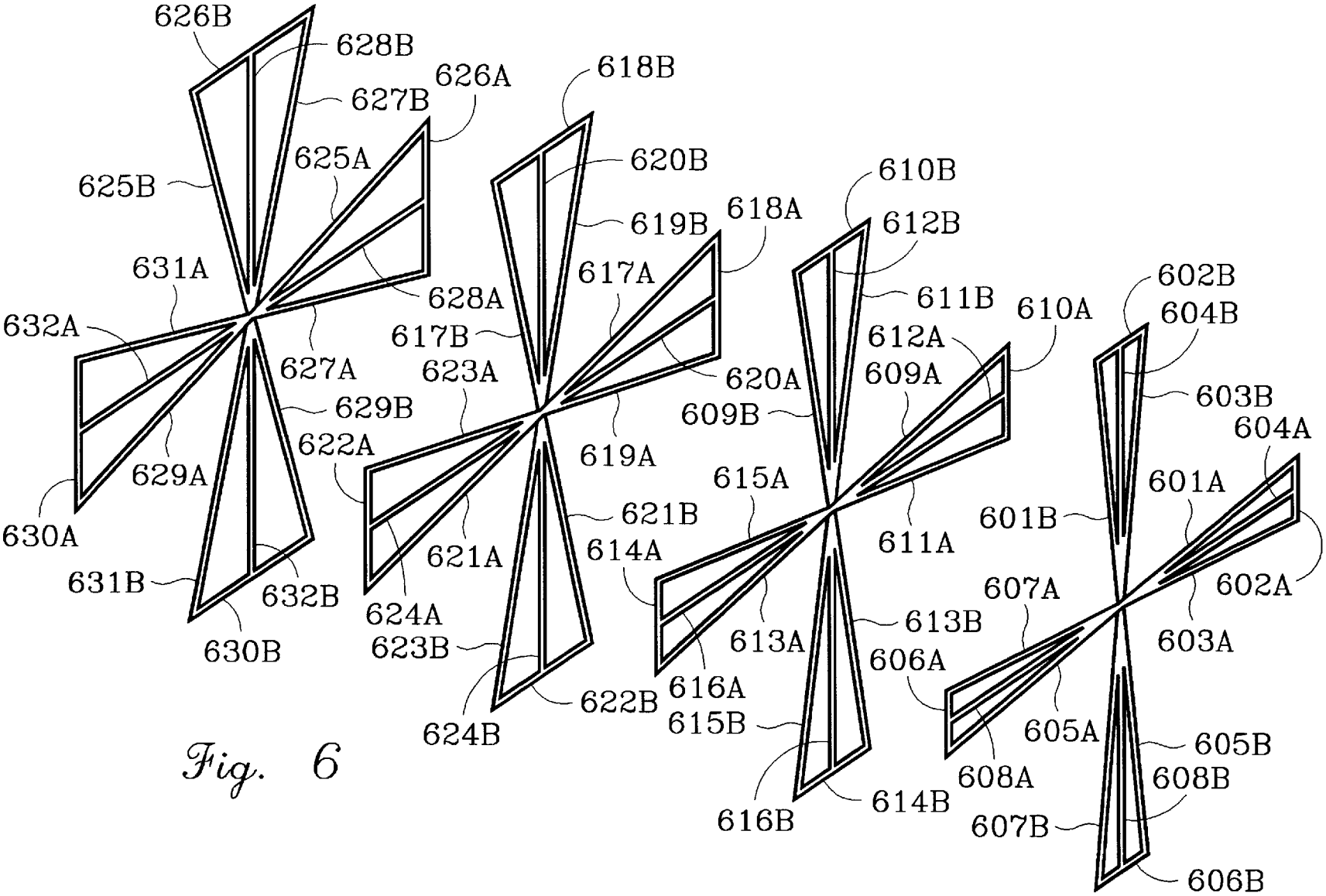
FIG. 6 illustrates an array of the improved structures to produce elliptically polarized radiation.

Both Yagi-Uda arrays and log-periodic arrays of strengthened double-delta antennas can be used in the ways that such end-fire arrays of half-wave dipoles are used. For example, FIG. 6 shows two end-fire arrays that are oriented to produce elliptically polarized radiation. For another example, FIG. 4 shows two Yagi-Uda arrays oriented so that the corresponding strengthened double-delta antenna structures of the two arrays are in the same vertical planes. In this case, there is an end-to-end or collinear orientation, because the parallel conductors of one array are positioned end-to-end with the equivalent parts of the other array. The arrays also could be oriented one above the other (broadside), or several arrays could be arranged in both orientations.

Since the gain of such large arrays tends to depend on the overall area of the array facing the direction of maximum radiation, it is unrealistic to expect much of a gain advantage from using strengthened double-delta antenna structures in large arrays. However, there are other advantages. Since the individual arrays in the overall array could have more gain if they were composed of strengthened double-delta antenna structures, the feeding system could be simpler because fewer individual structures would be needed to fill the overall space adequately. In addition, the superior ability of the strengthened double-delta antenna structures to suppress received signals arriving from undesired directions is a considerable advantage when the desired signals are small. For communication by reflecting signals off the moon, the ability to suppress undesired signals and noise is a great advantage.

It is well known that there is some minimum spacing needed between the individual antenna structures in collinear or broadside arrays so that the gain of the whole structure will be maximized. If the beam width of the individual structures were narrow, that minimum spacing would be larger than if the beam width were wide. In other words, if the gain of the individual structures were large, the spacing between them should be large. Large spacing, of course, increases the cost and weight of the supporting structure.

Because the half-wave dipole has no directivity in the principal H plane, Yagi-Uda arrays of half-wave dipoles usually have wider beam widths in the principal H plane than in the principal E plane. Therefore, the spacing necessary to obtain the maximum gain from two such arrays would be less for a broadside array than for a collinear array. That is, for a horizontally polarized array, it would be better from a cost and weight point of view to place the two arrays one above the other instead of beside each other. The double-delta and strengthened double-delta antenna structures present the opposite situation. Because these structures produce considerable directivity in the principal H plane, a Yagi-Uda array of them would have a narrower beam in the principal H plane than in the principal E plane. Therefore, it would be better to place two of these arrays side-by-side, as in FIG. 4, rather than one above the other. Of course, mechanical or other considerations may make other choices preferable.

It also is unrealistic to expect that long Yagi-Uda arrays of strengthened double-delta antennas structures will have a large gain advantage over long Yagi-Uda arrays of half-wave dipoles. The principle of a minimum necessary spacing applies here as well. It is not exactly true, but one can consider that the double-delta and strengthened double-delta antenna structures comprise dipoles, represented by the parallel conductors, joined by the diagonal conductors. Presented in that manner, a Yagi-Uda array of double-delta antenna structures could be considered equivalent to a broadside array of two Yagi-Uda arrays of dipoles.

Each of these two Yagi-Uda arrays has some beam width in the principal H plane and, therefore, these arrays should be separated by some minimum distance to produce the maximum gain for the combination. The longer the Yagi-Uda array is, of course, the narrower the individual H plane beams would be and the greater the spacing should be. That is, since the spacing is limited by the need to have approximately one-wavelength triangles, a long Yagi-Uda array of double-delta or strengthened double-delta antenna structures would not have as much gain as one might expect. In particular, a long array of such structures may not have much advantage at all over an array of half-wave dipoles of equal length.

That situation raises the question of how long Yagi-Uda arrays should be. One factor is that there usually is an advantage to making Yagi-Uda arrays of four strengthened double-delta antennas structures because four elements usually are required to produce an excellent suppression of the radiation to the rear of the array. Beyond that array length, the increase in gain for the increase in length probably will be disappointing because the distance between the parallel conductors cannot be increased very much. That is, the usual expectation that doubling the length producing twice the gain will not be realized. It probably will be wiser to employ more than one Yagi-Uda array of strengthened double-delta antenna structures in a larger collinear or broadside array.

APPLICATION—NONLINEAR POLARIZATION

Yet another application of strengthened double-delta antenna structures concerns nonlinear polarization. For communications with satellites or for communications on earth through the ionosphere, the polarization of the signal may be elliptical. In such cases, it may be advantageous to have both vertically polarized and horizontally polarized antennas. They may be connected together to produce a circularly polarized antenna, or they may be connected separately to the associated electronic equipment for a polarity diversity system. Also, they may be positioned at approximately the same place or they may be separated to produce both polarity diversity and space diversity.

FIG. 6 illustrates an array of strengthened double-delta antenna structures for achieving this kind of performance. Parts 601A to 632A form a vertically polarized array and parts 601B to 632B form a horizontally polarized array. The feeding system was not shown because it would be conventional and it would considerably confuse the drawing. If the corresponding strengthened double-delta antenna structures of the two arrays were approximately at the same positions along the supporting boom, as in FIG. 6, the phase relationship between equivalent parts in the two arrays usually would be about 90 degrees for approximately circular polarization. If the corresponding strengthened double-delta antenna structures of the two arrays were not in the same position on the boom, as is common with similar half-wave dipole arrays, some other phase relationship could be used because the difference in position plus the difference in phase could produce the 90 degrees for circular polarization. It is common with equivalent half-wave dipole arrays to choose the positions on the boom such that the two arrays can be fed in phase and still achieve circular polarization.

However, one should not assume that this choice of position on the boom and phasing does not make a difference in the radiation produced. If two half-wave dipoles were positioned at the same place and were out of phase by 90 degrees, there would tend to be a maximum of one polarity toward the front and a maximum of the other polarity toward the rear. For example, there may be a maximum of right-hand circular polarized radiation to the front and a maximum of left-hand circular polarized radiation to the rear. In the same example, there would be a null, ideally, of left-hand radiation to the front and a null of right-hand radiation to the rear. An equivalent array that produces the phase difference entirely by having the two dipoles in different positions on the boom would perform differently. Depending on how it was connected, it could have maxima of left-hand radiation to the front and rear. In such a case, the right-hand radiation would have maxima to the side and minima to the front and rear.

Of course, such arrays of individual dipoles would perform differently from such arrays of strengthened double-delta antenna structures. Also, if these structures were put into larger arrays, the patterns would change some more. Nevertheless, one should not assume that the choice of using phasing or positions on the boom to achieve circular polarization does not change the antenna performance. One must make the choice considering what kind of performance is desired for the particular application.

Although this arrangement of structures usually is chosen to produce circularly polarized radiation, one also should note that a phase difference of zero degrees or 180 degrees will produce linear polarization. As the array is shown in FIG. 6, those linear polarizations would be at a 45-degree angle to the earth, which probably would not be desired. It probably would be more desirable to rotate the array around the direction of the axes of the triangles by 45 degrees to produce vertical or horizontal polarization. With such an array, it would be possible to choose vertical polarization, horizontal polarization, or either of the two circular polarizations by switching the amount of phase difference applied to the system. Such a system may be useful to radio amateurs who use vertical polarization for frequency modulation, horizontal polarization for single sideband and Morse code, and circular polarization for satellite communication on very-high-frequency and ultra-high-frequency bands. It also could be useful on the high-frequency bands because received signals can have various polarities.

CONCLUSION

Except for the restrictions of size, weight, and cost, strengthened double-delta antenna structures could be used for almost whatever purposes that antennas are used. Beside the obvious needs to communicate sound, pictures, data, etc., they also could be used for such purposes as radar or for detecting objects near them for security purposes. Since they are much larger than half-wave dipoles, it would be expected that they would generally be used at very-high and ultra-high frequencies. However, they may not be considered to be too large for short-wave broadcasting because that service typically uses very large antennas. Some radio amateurs also use large antennas.

While this invention has been described in detail, it is not restricted to the exact embodiments shown. These embodiments serve to illustrate some of the possible applications of the invention rather than to define the limitations of the invention.

I claim:

1. An improved antenna structure, wherein said improved antenna structure comprises:

(a) two approximately parallel conductors, disposed in approximately the same plane, separated from the proximal point of said improved antenna structure by approximately equal distances, and disposed so that the centers of said approximately parallel conductors and said proximal point describe an imaginary line that is approximately perpendicular to said approximately parallel conductors;

(b) four diagonal conductors, of approximately equal length, disposed in said plane, connected from each end of said approximately parallel conductors to said proximal point, thereby producing two triangular current paths having perimeters of approximately one wavelength at the operating frequency; and (c) means for connecting the associated electronic equipment effectively in series with each of said two triangular current paths so that there are current maxima at said centers of said approximately parallel conductors, there are current maxima at said proximal point, and there are single current minima on said diagonal conductors between said current maxima;

(d) and wherein the improvement comprises the addition of two conductors connected between said proximal point of said improved antenna structure and said centers of said two approximately parallel conductors, thereby producing a strengthened antenna structure.

2. The improved antenna structure of claim 1 wherein the dimensions of said improved antenna structure are chosen to maximize the performance of said improved antenna structure in the direction perpendicular to said plane of said improved antenna structure.

3. The improved antenna structure of claim 1 wherein the dimensions of said improved antenna structure are chosen to minimize the performance of said improved antenna structure in the two directions in said plane of said improved antenna structure that are perpendicular to said approximately parallel conductors of said improved antenna structure.

4. The improved antenna structure of claim 1 wherein the dimensions of said improved antenna structure are chosen to produce a beneficial compromise between maximizing the performance of said improved antenna structure in the direction perpendicular to said plane of said improved antenna structure while minimizing the performance in other directions.

5. The improved antenna structure of claim 1 wherein at least one of the conductors has a circular cross-sectional area.

6. The improved antenna structure of claim 1 wherein at least one of the conductors has a solid cross-sectional area.

7. The improved antenna structure of claim 1 wherein at least one of the conductors has a tubular cross-sectional area.

8. The improved antenna structure of claim 1 wherein all the conductors have equal cross-sectional areas.

9. The improved antenna structure of claim 1 wherein the conductors do not have equal cross-sectional areas.

10. The improved antenna structure of claim 1 wherein said approximately parallel conductors are disposed approximately parallel to the ground.

11. The improved antenna structure of claim 1 wherein said approximately parallel conductors are disposed approximately perpendicular to the ground.

12. The improved antenna structure of claim 1 wherein said approximately parallel conductors are disposed neither approximately parallel to the ground nor approximately perpendicular to the ground.

13. An improved antenna system comprising at least one antenna, each of those antennas comprising two antenna structures, wherein:

(a) in each of said antenna structures, there are two approximately parallel conductors, disposed in approximately the same plane, and separated from the proximal point by approximately equal distances;

(b) in each of said antenna structures, the centers of said approximately parallel conductors and said proximal point describe an imaginary line that is approximately perpendicular to said approximately parallel conductors;

(c) in each of said antenna structures, four diagonal conductors, of approximately equal length, disposed in said plane, connect each of the ends of said approximately parallel conductors to the proximal point, thereby producing two triangular current paths having perimeters of approximately one wavelength at the operating frequency;

(d) in each of said antenna structures, there is a means for connecting the associated electronic equipment effectively in series with each of said two triangular current paths such that there are current maxima at the centers of said approximately parallel conductors, current maxima at said proximal point, and single current minima on said diagonal conductors between said current maxima;

(e) said planes of said two antenna structures are disposed approximately at right angles to each other;

(f) the imaginary lines between the centers of said approximately parallel conductors and the proximal points of said two antenna structures also approximately are the imaginary line where the two planes meet;

(g) said proximal points of said two antenna structures are connected to each other;

(h) said means for connecting to said associated electronic equipment also is such that the currents in the corresponding conductors of said two antenna structures are consistently related in amplitude by approximately equal ratios of values and are consistently unequal in phase by approximately equal amounts; and (i) said antennas are aligned so that the line of intersection of said two planes of each of said antennas approximately is the line of intersection of said two planes of the other antennas;

(j) and wherein the improvement to said improved antenna system consists of the addition to each of said antennas of two approximately perpendicular conductors connected between said proximal points and said centers of said approximately parallel conductors, thereby strengthening said improved antenna system.

14. The improved antenna system of claim 13 wherein the amplitudes of said currents in said corresponding conductors of said two antenna structures in each of said antennas are approximately equal and the phases of said currents are consistently unequal by approximately 90 degrees.

15. The improved antenna system of claim 13 wherein there is only one antenna in said improved antenna system.

16. The improved antenna system of claim 13 wherein the relative amplitudes and phases of the currents in the corresponding conductors of said antennas and the distances between said antennas are such that the performance of said improved antenna system is maximized in the principal E plane.

17. The improved antenna system of claim 13 wherein the relative amplitudes and phases of the currents in the corresponding conductors of said antennas and the distances between said antennas are such that the performance of said improved antenna system is minimized in directions other than in the principal E plane.

18. The improved antenna system of claim 13 wherein the relative amplitudes and phases of the currents in the corresponding conductors of said antennas and the distances between said antennas are such that the performance of said improved antenna system is a beneficial compromise between maximizing the performance of said improved antenna system in the principal E plane and minimizing the performance of said improved antenna system in other directions.

19. An improved antenna system comprising at least one antenna, each of those antennas comprising at least one antenna structure, wherein:

(a) in each of those antenna structures, there are two approximately parallel conductors, disposed in approximately the same plane, and separated from the proximal point of said antenna structure by approximately equal distances;

(b) in each of said antenna structures, the centers of said approximately parallel conductors and said proximal point describe an imaginary line that is approximately perpendicular to said approximately parallel conductors;

(c) in each of said antenna structures, four diagonal conductors, of approximately equal length, disposed in said plane, connect each of the ends of said approximately parallel conductors to the proximal point, thereby producing two triangular current paths having perimeters of approximately one wavelength at the operating frequency;

(d) said antenna structures, within each of said antennas, are disposed in planes approximately parallel to each other;

(e) said approximately parallel conductors, within each of said antennas, are all approximately parallel to each other; and (f) means are provided to connect the associated electronic equipment effectively in series with each of said two triangular current paths of at least one of said antenna structures in each of said antennas so that there are current maxima at the centers of said approximately parallel conductors, there are current maxima at said proximal points, and there are single current minima on said diagonal conductors between said current maxima;

(g) and wherein the improvement to said improved antenna system consists of the addition in each of said antenna structures of two approximately perpendicular conductors connected between said proximal point of said antenna structure and said centers of said two approximately parallel conductors.

20. The improved antenna system of claim 19 wherein:

(a) said approximately parallel conductors of all said antennas are approximately parallel to each other; and (b) said antennas are approximately aligned in the direction of said planes of said antenna structures that is in the direction perpendicular to said approximately parallel conductors.

21. The improved antenna system of claim 19 wherein:

(a) said approximately parallel conductors of all said antennas are approximately parallel to each other; and (b) said antennas are approximately aligned in the direction of said planes of said antenna structures that is in the direction parallel to said approximately parallel conductors.

22. The improved antenna system of claim 19 wherein:

(a) said approximately parallel conductors of all said antennas are approximately parallel to each other; and (b) said antennas are approximately aligned in the directions of said planes of said antenna structures that are either in the direction perpendicular to said approximately parallel conductors or in the direction parallel to said approximately parallel conductors, thereby producing a rectangular improved antenna system.

23. The improved antenna system of claim 19 wherein the relative amplitudes and phases of the currents in the corresponding conductors in said antennas and the distances between said antennas are chosen to maximize the performance of said improved antenna system to the front of said improved antenna system.

24. The improved antenna system of claim 19 wherein the relative amplitudes and phases of the currents in the corresponding conductors in said antennas and the distances between said antennas are chosen to minimize the performance of said improved antenna system in directions other than to the front of said improved antenna system.

25. The improved antenna system of claim 19 wherein the relative amplitudes and phases of the currents in the corresponding conductors in said antennas and the distances between said antennas are chosen to produce a beneficial compromise between maximizing the performance of said improved antenna system to the front of said improved antenna system and minimizing the performance in other directions.

26. The improved antenna system of claim 19 wherein there is only one of said antenna structures in each of said antennas.

27. The improved antenna system of claim 26, further including a reflecting screen disposed behind said improved antenna system to produce a substantially unidirectional performance to the front of said improved antenna system in the direction perpendicular to said planes of said antenna structures.

28. The improved antenna system of claim 19 wherein:

(a) there is more than one of said antenna structures in each of said antennas; and (b) the proximal points of said antenna structures, within each of said antennas, are aligned in the direction perpendicular to said planes of said antenna structures.

29. The improved antenna system of claim 28 wherein there is only one antenna in said improved antenna system.

30. The improved antenna system of claim 28 wherein:

(a) there are just two of said antenna structures, with substantially equal dimensions, in each of said antennas; and (b) said means of connection to said associated electronic equipment also is such that the currents in the corresponding conductors of said two antenna structures are approximately equal in amplitude and approximately 180 degrees out of phase with each other.

31. The improved antenna system of claim 28 wherein:

(a) there are just two of said antenna structures, with substantially equal dimensions, in each of said antennas;

(b) said means of connection to said associated electronic equipment also is such that the currents in the corresponding conductors of said two antenna structures are approximately equal in amplitude; and (c) the distance between said antenna structures and the phase difference between said currents in said corresponding conductors of said antenna structures are such that the performance of said improved antenna system is minimized in one of the two directions perpendicular to said planes of said antenna structures.

32. The improved antenna system of claim 31 wherein:

(a) the distance between said antenna structures is approximately a free-space quarter wavelength; and (b) the phase difference between said currents in said corresponding conductors of said antenna structures is approximately a consistent 90 degrees.

33. The improved antenna system of claim 28 wherein:

(a) there are just two antenna structures in each of said antennas;

(b) only the rear antenna structures are connected to said associated electronic equipment; and (c) the dimensions of said antenna structures and the distances between said antenna structures are such that the performance of said improved antenna system is substantially unidirectional to the front of said improved antenna system.

34. The improved antenna system of claim 23 wherein said antennas are substantially the same as each other in the dimensions of said antenna structures and in the distances between said antenna structures.

35. The improved antenna system of claim 34 wherein:

(a) a first half of said antennas have approximately parallel conductors that are oriented perpendicular to said approximately parallel conductors of the remaining second half of said antennas;

(b) said antennas are arranged in pairs, each of said pairs having approximately parallel conductors of the two orientations;

(c) said antennas also are arranged so that the corresponding proximal points in each of said pairs are much closer to each other than the length of a wavelength at the operating frequency; and (d) said means of connection to said associated electronic equipment also is such that the currents in the conductors of said first half of said antennas are approximately equal in amplitude and consistently out of phase by approximately 90 degrees to the currents in the corresponding conductors of said remaining second half of said antennas, thereby producing an approximately circularly polarized improved antenna system.

36. The improved antenna system of claim 34 wherein:

(a) a first half of said antennas have approximately parallel conductors that are oriented perpendicular to the approximately parallel conductors of the remaining second half of said antennas;

(b) said antennas are arranged in pairs, each of said pairs having approximately parallel conductors of the two orientations;

(c) said proximal points of said antenna structures in both of said antennas in each of said pairs are aligned with each other;

(d) said means of connection to said associated electronic equipment also is such that the currents in the corresponding conductors in each of said pairs are equal in amplitude; and (e) the perpendicular distances between the planes of the corresponding antenna structures in each of said pairs and the phase relationship between said currents in said corresponding conductors in each of said pairs are such that approximately circularly polarized radiation is produced to the front of said improved antenna system.

37. The improved antenna system of claim 28 wherein:

(a) only the second antenna structure from the rear in each of said antennas, is connected to the associated electronic equipment; and (b) the dimensions of said antenna structures and the distances between said antenna structures are such that the performance of said improved antenna system is substantially unidirectional to the front of said improved antenna system.

38. The improved antenna system of claim 37 wherein the dimensions of said antenna structures and the distances between said antenna structures produce the maximum performance of said improved antenna system in the direction to the front of said improved antenna system.

39. The improved antenna system of claim 37 wherein the dimensions of said antenna structures and the distances between said antenna structures produce the minimum performance of said improved antenna system in directions other than in the direction to the front of said improved antenna system.

40. The improved antenna system of claim 37 wherein the dimensions of said antenna structures and the distances between said antenna structures produce a beneficial compromise between maximizing the performance of said improved antenna system in the direction to the front of said improved antenna system and minimizing the performance of said improved antenna system in other directions.

41. The improved antenna system of claim 28 wherein:

(a) the resonant frequencies of said antenna structures are progressively and proportionally higher from the rear to the front of each of said antennas;

(b) the distances between said antenna structures are progressively and proportionally shorter from the rear to the front of each of said antennas;

(c) within each of said antennas, the ratio of said resonant frequencies of all the adjacent antenna structures and the ratio of all the adjacent distances between said antenna structures are approximately equal ratios;

(d) within each of said antennas, all of said antenna structures are connected to each other, so that the phase relationship produced by the time taken for the energy to travel between them by said connection is essentially equal to the phase relationship that is consistent with travel at the speed of light;

(e) within each of said antennas, said connection between said antenna structures also produces, in addition to the phase difference caused by the travelling time of the energy, an additional phase reversal between said adjacent antenna structures; and (f) the antenna structures at the front of each of said antennas are connected to the associated electronic equipment.

42. The improved antenna system of claim 41 wherein the differences in said resonant frequencies are caused by all the dimensions of said antenna structures approximately being proportionally different.

43. The improved antenna system of claim 41 wherein:

(a) the distances between said approximately parallel conductors within each of said antenna structures are all approximately equal distances; and (b) the differences in said resonant frequencies are caused by the lengths of said approximately parallel conductors being different.

44. The improved antenna system of claim 41 wherein the method of producing the proportional resonant frequencies is a compromise between having all the dimensions of said antenna structures proportional to each other and having equal distances between said approximately parallel conductors in each of said antenna structures.

* * * * *